US009972431B2

(12) United States Patent
Moriyama et al.

(10) Patent No.: US 9,972,431 B2
(45) Date of Patent: May 15, 2018

(54) LAMINATED COIL COMPONENT

(71) Applicant: Murata Manufacturing Co., Ltd., Kyoto (JP)

(72) Inventors: Yosuke Moriyama, Nagaokakyo (JP); Mitsuru Odahara, Nagaokakyo (JP); Akihiro Ono, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days. days.

(21) Appl. No.: 15/080,078

(22) Filed: Mar. 24, 2016

(65) Prior Publication Data

US 2016/0284463 A1 Sep. 29, 2016

(30) Foreign Application Priority Data

Mar. 27, 2015 (JP) ..... 2015-066916
Jan. 12, 2016 (JP) ..... 2016-003465

(51) Int. Cl.
*H01F 27/28* (2006.01)
*H01F 5/00* (2006.01)
*H01F 17/00* (2006.01)

(52) U.S. Cl.
CPC ... *H01F 17/0013* (2013.01); *H01F 2017/002* (2013.01)

(58) Field of Classification Search
CPC ..... H01F 27/2804; H01F 2027/2809; H01F 17/0013; H01F 17/0006; H01F 2017/002
USPC ..... 336/200, 223
See application file for complete search history.

(56) References Cited

U.S. PATENT DOCUMENTS

2007/0296536 A1* 12/2007 Odahara ..... H01F 17/0013 336/200
2010/0253464 A1* 10/2010 Miyoshi ..... H01F 17/0013 336/200

FOREIGN PATENT DOCUMENTS

JP 2001-044038 A 2/2001
JP 2001-176725 A 6/2001
JP 2005-167130 A 6/2005
JP 2010-245134 A 10/2010

* cited by examiner

*Primary Examiner* — Mangtin Lian
(74) *Attorney, Agent, or Firm* — Studebaker & Brackett PC

(57) ABSTRACT

A laminated coil component has an element body formed by laminating a plurality of ceramic layers, and a coil conductor disposed inside the element body. The coil conductor has coil pattern portions disposed on the plurality of the ceramic layers and including line portions and land portions disposed at ends of the line portions, and pattern connecting portions connecting the land portion to each other between the coil pattern portions arranged adjacently in a laminating direction of the ceramic layers. The land portions overlap with the line portions located on the opposite side of the pattern connecting portions in the laminating direction when viewed in the laminating direction such that the centers of the land portions do not overlap with the line portions located on the opposite side of the pattern connecting portions in the laminating direction when viewed in the laminating direction.

11 Claims, 9 Drawing Sheets

LAMINATED COIL COMPONENT

CROSS REFERENCE TO RELATED APPLICATIONS

This application claims benefit of priority to Japanese Patent Application 2015-066916 filed Mar. 27, 2015, and to Japanese Patent Application No. 2016-003465 filed Jan. 12, 2016, the entire content of which is incorporated herein by reference.

TECHNICAL FIELD

The present disclosure relates to a laminated coil component.

BACKGROUND

Conventional laminated coil components include a coil as described in Japanese Patent Publication No. 2001-176725. This laminated coil component has an element body formed by laminating a plurality of ceramic layers and a coil conductor disposed inside the element body. The coil conductor has coil pattern portions disposed on the ceramic layers and including land portions at both ends and line portions between the land portions at both ends, and pattern connecting portions connecting the land portions arranged adjacently in the laminating direction of the ceramic layers.

SUMMARY

Problem to be Solved by the Disclosure

The conventional laminated coil component has the land portions overlapping with the line portions when viewed in the laminating direction. Therefore, the land portions are adjacent to the line portions across the ceramic layers.

On the other hand, when the ceramic layers and the coil pattern portions are laminated to produce the laminated coil component, the line portions and the land portions of the coil pattern portions are formed in a process of applying a conductive paste onto green sheets used as the ceramic layers with a printing method, etc.

When a width of land portions is wider as compared to a width of the line portions, an amount of the conductive paste applied to the land portions becomes larger in this application process and a coating thickness at the centers of the land portions therefore becomes greater than a coating thickness of the line portions.

When the coating thickness at the centers of the land portions becomes greater, the conductive paste at the centers of the land portions may penetrate the green sheets used as the ceramic layers in a process of lamination and may come into contact with the line portions. Therefore, the land portions may short-circuit with the line portions arranged adjacently to the land portions in the laminating direction.

In general, with regard to the laminated coil components, thinner ceramic layers can implement a lower-height coil component, and thicker coil pattern portions can make a DC resistance value of the coil smaller. Therefore, this problem becomes more significant in a laminated coil component having the ceramic layers made thinner and the coil pattern portions made thicker.

Therefore, a problem to be solved by the present disclosure is to provide a laminated coil component capable of preventing a short circuit between a land portion and a line portion arranged adjacently in the laminating direction.

Solutions to the Problems

To solve the problem, a laminated coil component of the present disclosure comprises an element body formed by laminating a plurality of ceramic layers, and a coil conductor disposed inside the element body; the coil conductor has coil pattern portions disposed on the plurality of ceramic layers and including line portions and land portions disposed at ends of the line portions, and pattern connecting portions connecting the land portions to each other between the coil pattern portions arranged adjacently in a laminating direction of the ceramic layers; and the land portions overlap with the line portions located on the opposite side of the pattern connecting portions in the laminating direction when viewed in the laminating direction such that the centers of the land portions do not overlap with the line portions located on the opposite side of the pattern connecting portions in the laminating direction when viewed in the laminating direction.

According to the laminated coil component of the present disclosure, the thickness of each of the land portions is maximized at a center, which does not overlap with the line portion located on the opposite side of the pattern connecting portion in the laminating direction. Therefore, when the laminated coil component is produced by laminating green sheets used as the ceramic layers on which a conductive paste forming the coil pattern portions is printed, the center of each of the land portions having an increased coating thickness of the conductive paste does not penetrate the green sheet used as the ceramic layer between the land portion and the line portion in the laminating direction and does not come into contact with the line portion. Therefore, a short circuit can be prevented between the land portion and the line portion arranged adjacently in the laminating direction.

In the laminated coil component of an embodiment, when viewed in the laminating direction, the land portions have a circular shape, and a line width of the line portions is smaller than a radius of the land portions.

With this configuration, the line width of the line portions can be made smaller to achieve a reduction in size.

In the laminated coil component of an embodiment, when viewed in the laminating direction, end edges of the line portions farther from the centers of the land portions are partially located inside the outer peripheral edges of the land portions.

With this configuration, the line width of the line portions can be made smaller to achieve a reduction in size.

In the laminated coil component of an embodiment, when viewed in the laminating direction, end edges of the line portions farther from the centers of the land portions are in contact with the outer peripheral edges of the land portions.

With this configuration, the line width of the line portions can be made larger and, therefore, the resistance of the line portions can be made smaller, as compared to the configuration in which the end edges farther from the centers of the land portions are partially located inside the outer peripheral edges of the land portions.

In the laminated coil component of an embodiment, when viewed in the laminating direction, the line portions are arranged in a ring shape, and the centers of the land portions are located inside the inner peripheral edge of the line portions.

With this configuration, the land portions are hardly located outside the outer peripheral edge of line portions. Thus, this reduces the risk of the land portions being exposed to the outside at the time of dicing cut of the laminated coil component.

In the laminated coil component of an embodiment, when viewed in the laminating direction, the line portions are arranged in a ring shape, and the centers of the land portions are located outside the outer peripheral edge of the line portions.

With this configuration, the land portions are hardly located inside the inner peripheral edge of the line portions. Thus, impedance characteristics are improved.

In the laminated coil component of an embodiment, when viewed in the laminating direction, an area of an overlapping portion between each of the land portions and the line portion located on the opposite side of the pattern connecting portion in the laminating direction has a proportion of 50% or less relative to the area of the land portion.

With this configuration, a short circuit can more reliably be prevented between the land portion and the line portion.

Effect of the Disclosure

The laminated coil component of the present disclosure can prevent a short circuit between the land portion and the line portion arranged adjacently in the laminating direction.

DETAILED DESCRIPTION

The present disclosure will now be described in detail with reference to shown embodiments.

First Embodiment

Figure 1:
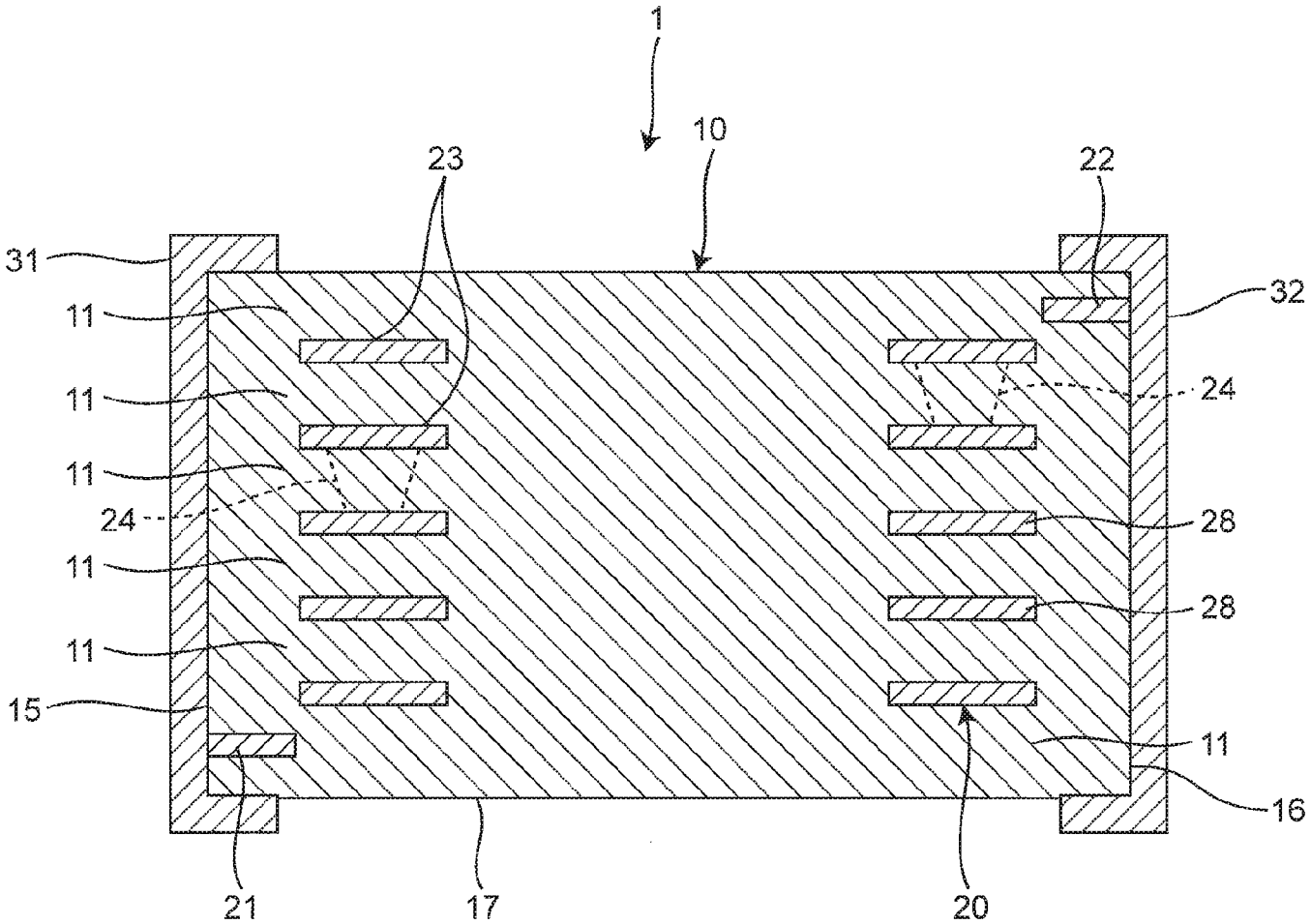
FIG. 1 is a cross-sectional view of a laminated coil component according to a first embodiment of the present disclosure.
Figure 2:
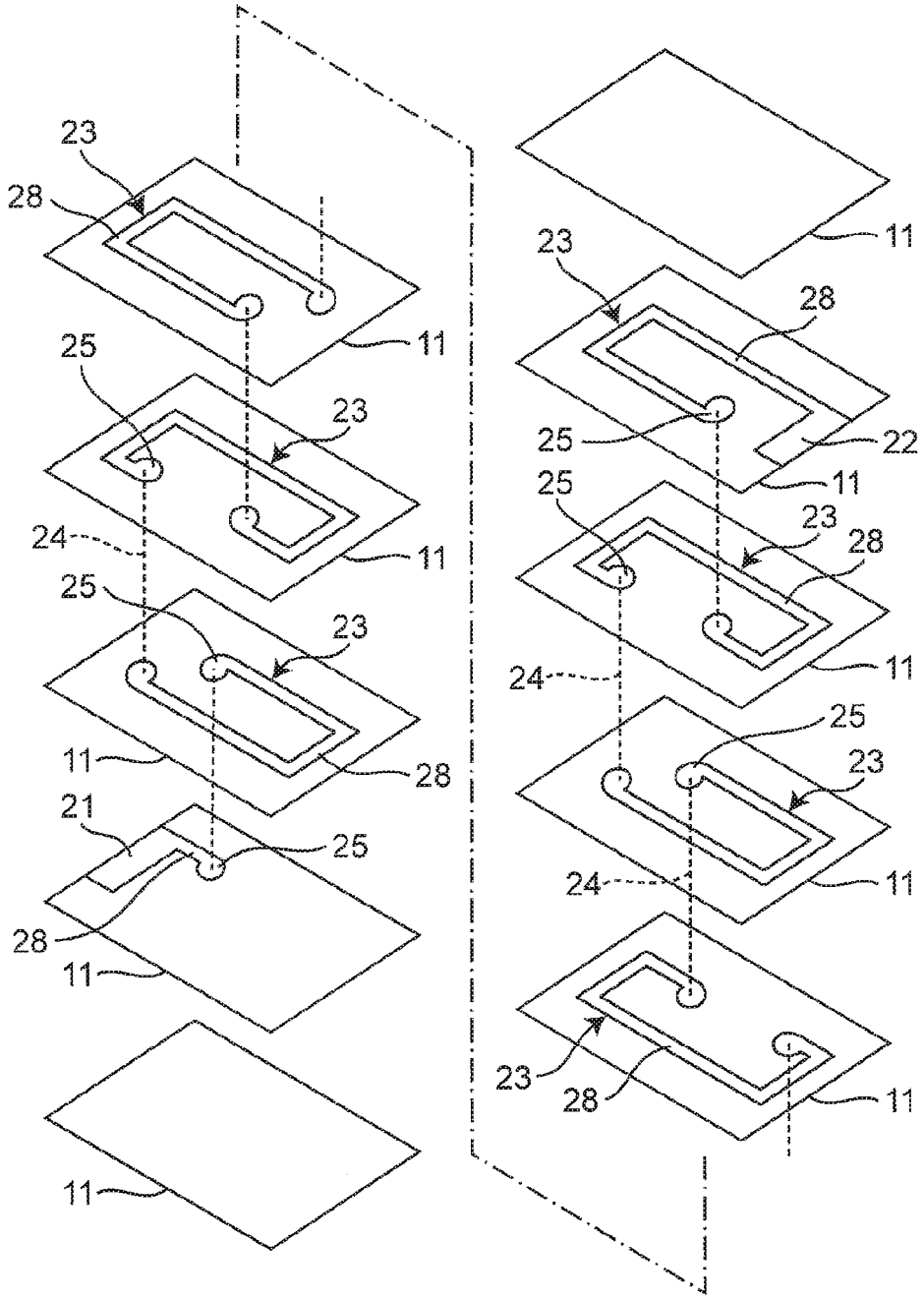
FIG. 2 is an exploded perspective view of the laminated coil component according to the first embodiment.

FIG. 1 is a cross-sectional view of a laminated coil component according to a first embodiment of the present disclosure. FIG. 2 is an exploded perspective view of the laminated coil component. FIG. 3A to 3D are views of an end portion of a coil pattern portion. FIG. 4 is an enlarged cross-sectional view of the laminated coil component. As shown in FIGS. 1 to 4, a laminated coil component 1 has an element body 10, a helical coil conductor 20 disposed inside the element body 10, and external electrodes 31, 32 disposed on a surface of the element body 10 and electrically connected to the coil conductor 20.

The laminated coil component 1 is electrically connected via the external electrodes 31, 32 to wiring of a circuit board not shown. The laminated coil component 1 is used as a noise removal filter, for example, and is used in an electronic device such as a personal computer, a DVD player, a digital camera, a TV, a portable telephone, and automotive electronics.

The element body 10 is formed by laminating a plurality of ceramic layers 11. The ceramic layers 11 are made of a magnetic material such as ferrite, for example. The element body 10 is formed into a substantially rectangular parallelepiped shape. The surface of the element body 10 has a first end surface 15, a second end surface 16 located on the opposite side of the first end surface 15, and a side surface 17 located between the first end surface 15 and the second end surface 16. The first end surface 15 and the second end surface 16 extend in a laminating direction of the ceramic layers 11.

The first external electrode 31 covers the whole of the first end surface 15 of the element body 10 and an end of the side surface 17 of the element body 10 close to the first end surface 15. The second external electrode 32 covers the whole of the second end surface 16 of the element body 10 and an end of the side surface 17 of the element body 10 close to the second end surface 16.

The coil conductor 20 is made of an electrically conductive material such as Ag or Cu, for example. The coil conductor 20 is helically wound in the laminating direction. A first extraction conductor 21 and a second extraction conductor 22 are disposed at both ends of the coil conductor 20.

The first extraction conductor 21 is exposed from the first end surface 15 of the element body 10 and brought into contact with the first external electrode 31, and the coil conductor 20 is electrically connected via the first extraction conductor 21 to the first external electrode 31. The second extraction conductor 22 is exposed from the second end surface 16 of the element body 10 and brought into contact with the second external electrode 32, and the coil conductor 20 is electrically connected via the second extraction conductor 22 to the second external electrode 32.

The coil conductor 20 has coil pattern portions 23 formed on upper surfaces of the ceramic layers 11 and pattern connecting portions (via conductors) 24 disposed in a penetrating manner in the thickness direction of the ceramic layers 11. The coil pattern portions 23 include land portions 25 at ends therefor and line portions 28 connected to the land portions 25. The pattern connecting portions 24 connect the land portions 25 arranged adjacently in the laminating direction. As a result, the land portions 25 of the coil pattern portions 23 are connected by the pattern connecting portions 24 to form the helical coil conductor 20. Therefore, the coil pattern portions 23 are electrically serially connected to each other to form a helix and, when viewed in the laminating direction, the multiple line portions 28 partially overlap with each other to form a rectangular ring shape as a whole.

Each of the pattern connecting portions 24 is formed along with the land portion 25 on the upper side in the laminating direction. Specifically, a circular hole is made in a green sheet used as the ceramic layer 11 in a process of production and this hole is filled with a conductive paste forming the pattern connecting portion 24. When the pattern connecting portion 24 is formed, the land portion 25 is formed at the same time on the green sheet.

In this embodiment, the land portions 25 and the pattern connecting portions 24 have a circular shape when viewed in the laminating direction. The diameter of the land portions 25 is larger than the diameter of the pattern connecting portions 24. The land portions 25 may have a rectangular shape or an elliptical shape when viewed in the laminating direction.

Figure 3A:
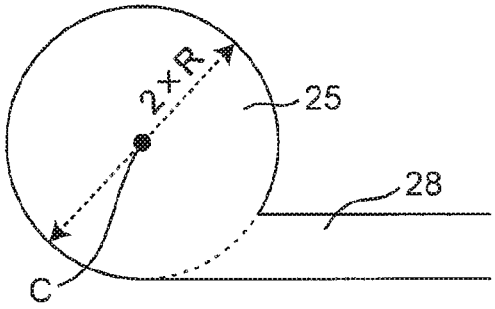
FIG. 3A is a view of an end portion of a coil pattern portion according to the first embodiment.
Figure 3B:
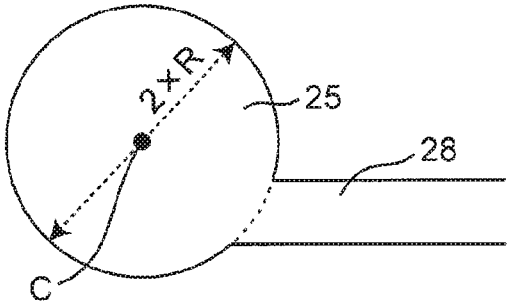
FIG. 3B is a view of an end portion of a coil pattern portion according to the first embodiment.
Figure 4:
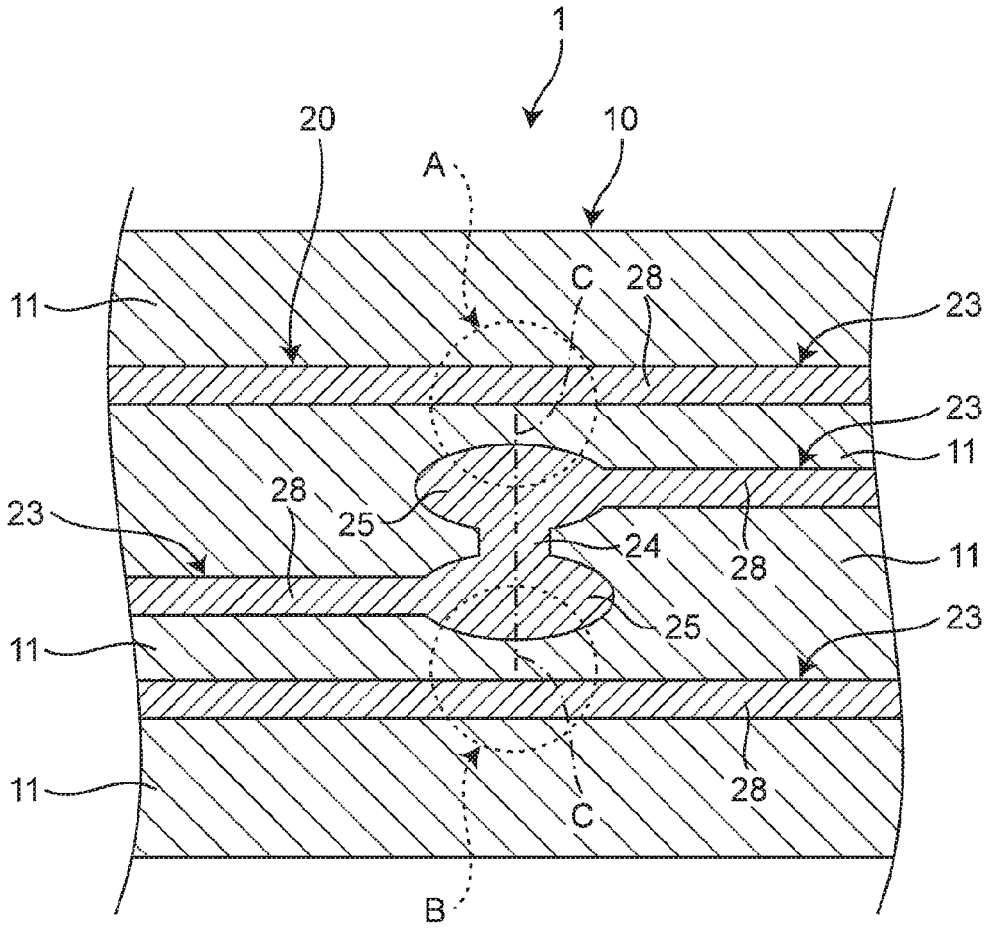
FIG. 4 is an enlarged cross-sectional view of the laminated coil component according to the first embodiment.

Each of the land portions 25 located at ends of the coil pattern portions 23 of this embodiment has a boundary with the line portion 28 shown as a dotted-line portion in FIG. 3A. Specifically, when the land portion 25 has a circular shape, the outer peripheral edge of the circle is the boundary with the line portion 28. A center C of the land portion 25 is the center of the circle. The same applies to another positional relationship between the land portion 25 and the line portion 28 as shown in FIG. 3B.

Figure 3C:
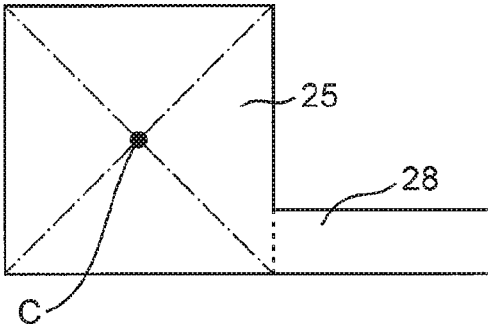
FIG. 3C is a view of an end portion of a coil pattern portion according to the first embodiment.
Figure 3D:
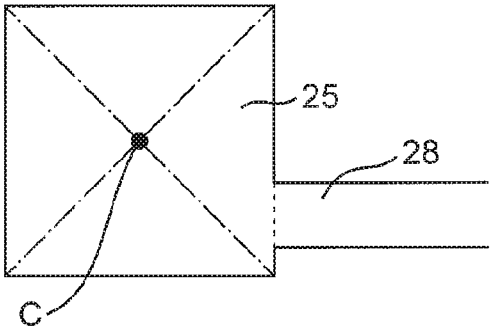
FIG. 3D is a view of an end portion of a coil pattern portion according to the first embodiment.

When the land portion 25 has a rectangular shape, the boundary is dotted-line portions shown in FIGS. 3C and 3D. Specifically, the boundary is an extrapolated portion of a side coming into contact with the line portion 28 out of the sides of the rectangular land portion 25. The center C of the land portion 25 is an intersection point of the diagonals of the rectangle.

Each of the land portions 25 is formed by printing a conductive paste on a green sheet used as the ceramic layer 11. Therefore, the thickness of the land portion 25 is maximized at the center C. When the green sheets used as the ceramic layers 11 are laminated, the center C of the land portion 25 comes close to the line portion 28 located on the opposite side of the pattern connecting portion 24 in the laminating direction. Therefore, the land portions 25 come close to the line portions 28 in portions A and B of FIG. 4.

Figure 5:
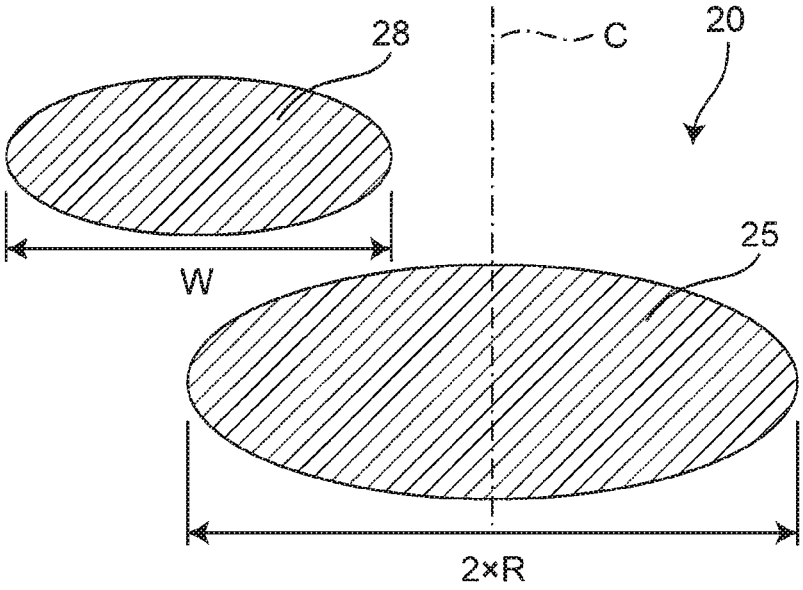
FIG. 5 is a cross-sectional view perpendicular to an extending direction of a line portion in a portion A of FIG. 4.
Figure 6:
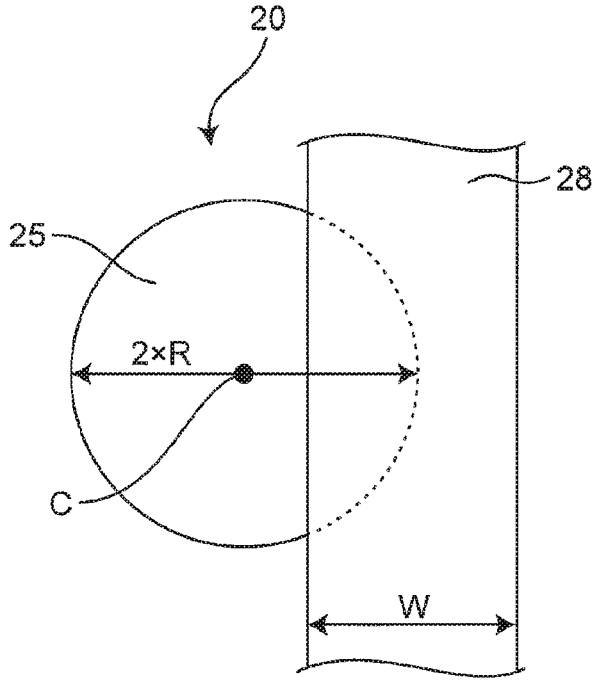
FIG. 6 is a diagram of a positional relationship between a land portion and the line portion in the portion A of FIG. 4 viewed in a laminating direction.

FIG. 5 is a cross-sectional view perpendicular to an extending direction of the line portion 28 in the portion A of FIG. 4, and FIG. 6 is a diagram of a positional relationship between the land portion 25 and the line portion 28 in the portion A of FIG. 4 viewed in the laminating direction. As shown in FIGS. 5 and 6, the land portion 25 overlaps with the line portion 28 located on the opposite side of the pattern connecting portion 24 in the laminating direction when viewed in the laminating direction, and the center C of the land portion 25 does not overlap with the line portion 28 located on the opposite side of the pattern connecting portion 24 in the laminating direction when viewed in the laminating direction. The line width W of the line portion 28 is equal to or larger than the diameter R of the land portion 25. The portion B of FIG. 4 has the same configuration and will not be described.

In the laminated coil component 1, the thickness of each of the land portions 25 is maximized at the center C, which does not overlap with the line portion 28 located on the opposite side of the pattern connecting portion 24 in the laminating direction. Therefore, when the laminated coil component 1 is produced by laminating the green sheets used as the ceramic layers 11 on which the conductive paste forming the coil pattern portions 23 is printed, the center C of each of the land portions 25 does not penetrate the green sheet used as the ceramic layer 11 between the land portion 25 and the line portion 28 in the laminating direction and does not come into contact with the line portion 28. Therefore, a short circuit can be prevented between the land portion 25 and the line portion 28 arranged adjacently in the laminating direction. Particularly, although it is recently required to make the ceramic layers 11 thinner for producing a thinner coil and to make the coil conductor 20 thicker for lowering resistance, the configuration of the present disclosure can effectively prevent the short circuit between the land portion 25 and the line portion 28.

In this example, preferably, when viewed in the laminating direction, an area of an overlapping portion between the land portion 25 and the line portion 28 located on the opposite side of the pattern connecting portion 24 in the laminating direction has a proportion of 50% or less relative to the area of the land portion 25. In this case, the short circuit can more reliably be prevented between the land portion 25 and the line portion 28.

Second Embodiment

Figure 7:
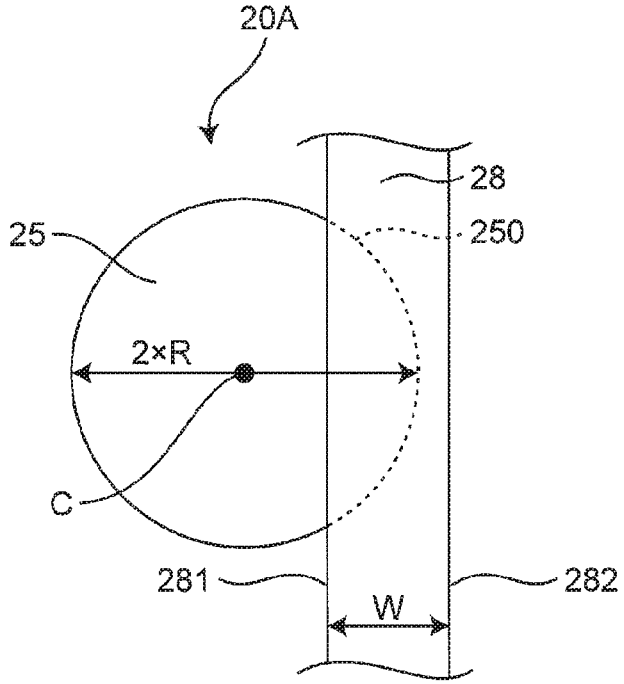
FIG. 7 is a diagram of a positional relationship between the land portion and the line portion viewed in the laminating direction according to a second embodiment of the present disclosure.

FIG. 7 is a diagram of a positional relationship between the land portion 25 and the line portion 28 viewed in the laminating direction according to a second embodiment of the present disclosure. The second embodiment is different from the first embodiment in the positional relationship between the land portion and the line portion.

As shown in FIG. 7, in a coil conductor 20A of the second embodiment, as is the case with the configuration of the first embodiment, the land portion 25 overlaps with the line portion 28 located on the opposite side of the pattern connecting portion 24 in the laminating direction when viewed in the laminating direction, and the center C of the land portion 25 does not overlap with the line portion 28 located on the opposite side of the pattern connecting portion 24 in the laminating direction when viewed in the laminating direction. Additionally, when viewed in the laminating direction, the line width W of the line portion 28 is smaller than the radius R of the land portion 25.

The line portion 28 has first and second end edges 281, 282 in the line width W direction. The second end edge 282 is located farther from the center C of the land portion 25 than the first end edge 281. The second end edge 282 of the line portion 28 is located outside an outer peripheral edge 250 of the land portion 25.

According to the second embodiment, when viewed in the laminating direction, the line width W of the line portion 28 is smaller than the radius R of the land portion 25 and, therefore, the line width W of the line portion 28 can be made smaller to achieve a reduction in size.

Third Embodiment

Figure 8:
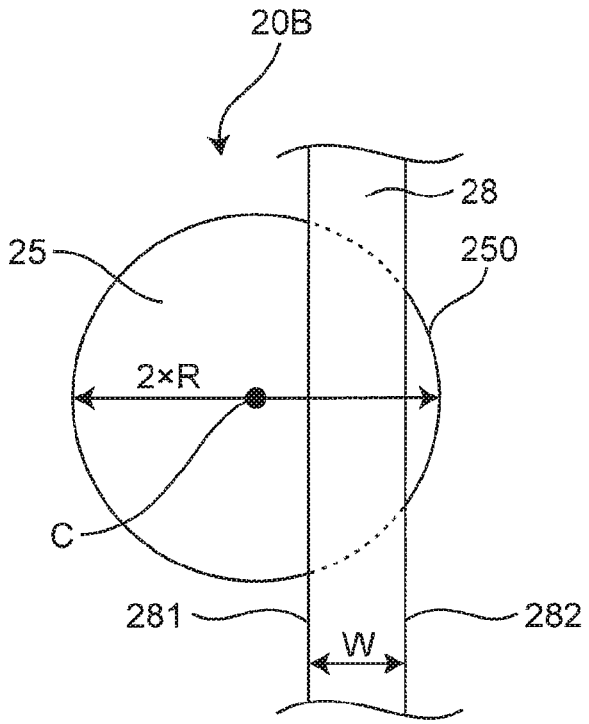
FIG. 8 is a diagram of a positional relationship between the land portion and the line portion viewed in the laminating direction according to a third embodiment of the present disclosure.

FIG. 8 is a diagram of a positional relationship between the land portion 25 and the line portion 28 viewed in the laminating direction according to a third embodiment of the present disclosure. The third embodiment is different from the first embodiment in the positional relationship between the land portion and the line portion.

As shown in FIG. 8, in a coil conductor 20B of the third embodiment, as is the case with the configuration of the first embodiment, the land portion 25 overlaps with the line portion 28 located on the opposite side of the pattern connecting portion 24 in the laminating direction when viewed in the laminating direction, and the center C of the land portion 25 does not overlap with the line portion 28 located on the opposite side of the pattern connecting portion 24 in the laminating direction when viewed in the laminating direction.

Additionally, the line portion 28 has the first and second end edges 281, 282 in the line width W direction. The second end edge 282 is located farther from the center C of the land portion 25 than the first end edge 281. When viewed in the laminating direction, the second end edge 28 of the line portion 28 is partially located inside the outer peripheral edge 250 of the land portion 25. Even in this case, when viewed in the laminating direction, the line width W of the line portion 28 is smaller than the radius R of the land portion 25.

According to the third embodiment, when viewed in the laminating direction, the second end edge 282 of the line portion 28 is partially located inside the outer peripheral edge 250 of the land portion 25 and, therefore, the line width W of the line portion 28 can be made smaller to achieve a reduction in size.

Fourth Embodiment

Figure 9:
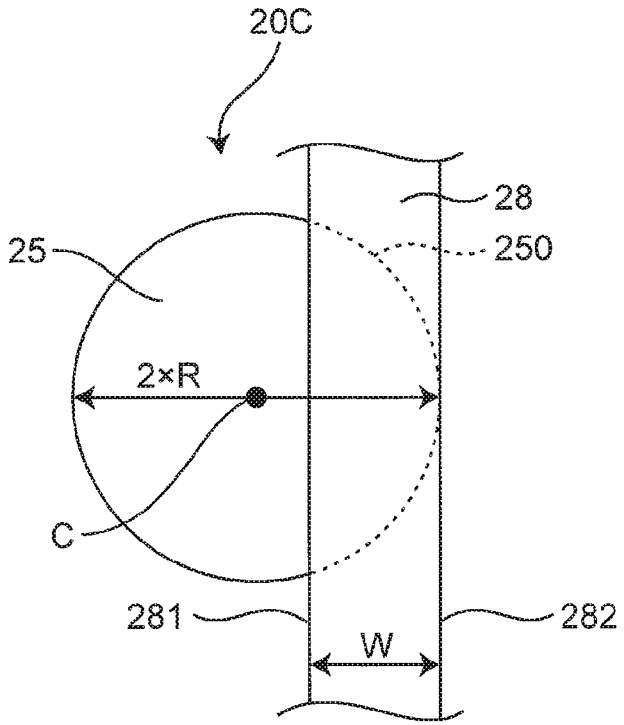
FIG. 9 is a diagram of a positional relationship between the land portion and the line portion viewed in the laminating direction according to a fourth embodiment of the present disclosure.

FIG. 9 is a diagram of a positional relationship between the land portion 25 and the line portion 28 viewed in the laminating direction according to a fourth embodiment of the present disclosure. The fourth embodiment is different from the first embodiment in the positional relationship between the land portion and the line portion.

As shown in FIG. 9, in a coil conductor 20C of the fourth embodiment, as is the case with the configuration of the first embodiment, the land portion 25 overlaps with the line portion 28 located on the opposite side of the pattern connecting portion 24 in the laminating direction when viewed in the laminating direction, and the center C of the land portion 25 does not overlap with the line portion 28 located on the opposite side of the pattern connecting portion 24 in the laminating direction when viewed in the laminating direction.

Additionally, the line portion 28 has the first and second end edges 281, 282 in the line width W direction. The second end edge 282 is located farther from the center C of the land portion 25 than the first end edge 281. When viewed in the laminating direction, the second end edge 282 of the line portion 28 is in contact with the outer peripheral edge 250 of the land portion 25. Even in this case, when viewed in the laminating direction, the line width W of the line portion 28 is smaller than the radius R of the land portion 25.

According to the fourth embodiment, since the second end edge 282 of the line portion 28 is in contact with the outer peripheral edge 250 of the land portion 25 when viewed in the laminating direction, the line width W of the line portion 28 can be made larger and, therefore, the resistance of the line portion 28 can be made smaller, as compared to the configuration in which the end edge 282 farther from the center C of the land portion 25 is partially located inside the outer peripheral edge 250 of the land portion 25.

Fifth Embodiment

Figure 10:
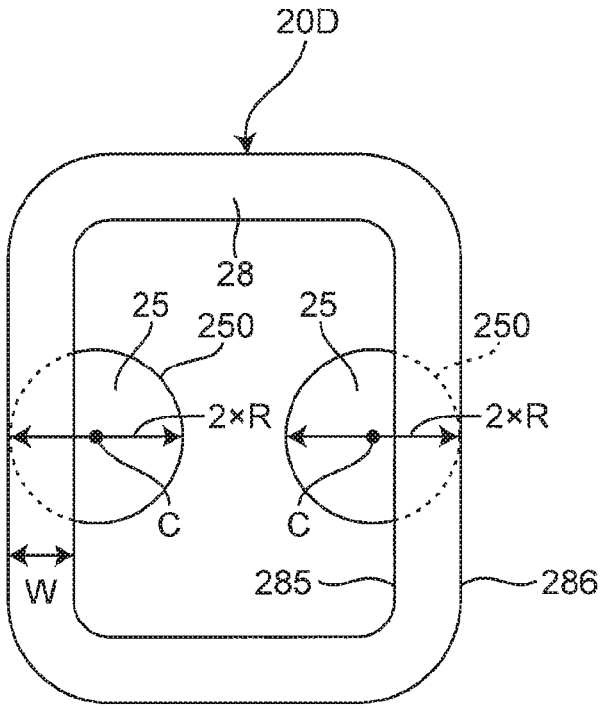
FIG. 10 is a diagram of a positional relationship between the land portion and the line portion viewed in the laminating direction according to a fifth embodiment of the present disclosure.

FIG. 10 is a diagram of a positional relationship between the land portion 25 and the line portion 28 viewed in the laminating direction according to a fifth embodiment of the present disclosure. The fifth embodiment is different from the first embodiment in the positional relationship between the land portion and the line portion.

As shown in FIG. 10, in a coil conductor 20D of the fifth embodiment, as is the case with the configuration of the first embodiment, the land portion 25 overlaps with the line portion 28 located on the opposite side of the pattern connecting portion 24 in the laminating direction when viewed in the laminating direction, and the center C of the land portion 25 does not overlap with the line portion 28 located on the opposite side of the pattern connecting portion 24 in the laminating direction when viewed in the laminating direction.

Additionally, when viewed in the laminating direction, the multiple line portions 28 partially overlap with each other to form a rectangular ring shape as a whole. The line portions 28 may be arranged in a circular shape or an elliptical shape.

The line portions 28 have an inner peripheral edge 285 and an outer peripheral edge 286 in the line width W direction. The centers C of the land portions 25 are located inside the inner peripheral edge 285 of the line portions 28. The outer peripheral edge 286 of the line portions 28 is in contact with the outer peripheral edges 250 of the land portions 25. Even in this case, when viewed in the laminating direction, the line width W of the line portions 28 is smaller than the radius R of the land portions 25.

According to the fifth embodiment, when viewed in the laminating direction, the centers C of the land portions 25 are located inside the inner peripheral edge 285 of the line portions 28 arranged in a ring shape and, therefore, the land portions 25 are hardly located outside the outer peripheral edge 286 of line portions 28. Thus, this reduces the risk of the land portions 25 being exposed to the outside at the time of dicing cut of the laminated coil component 1.

Sixth Embodiment

Figure 11:
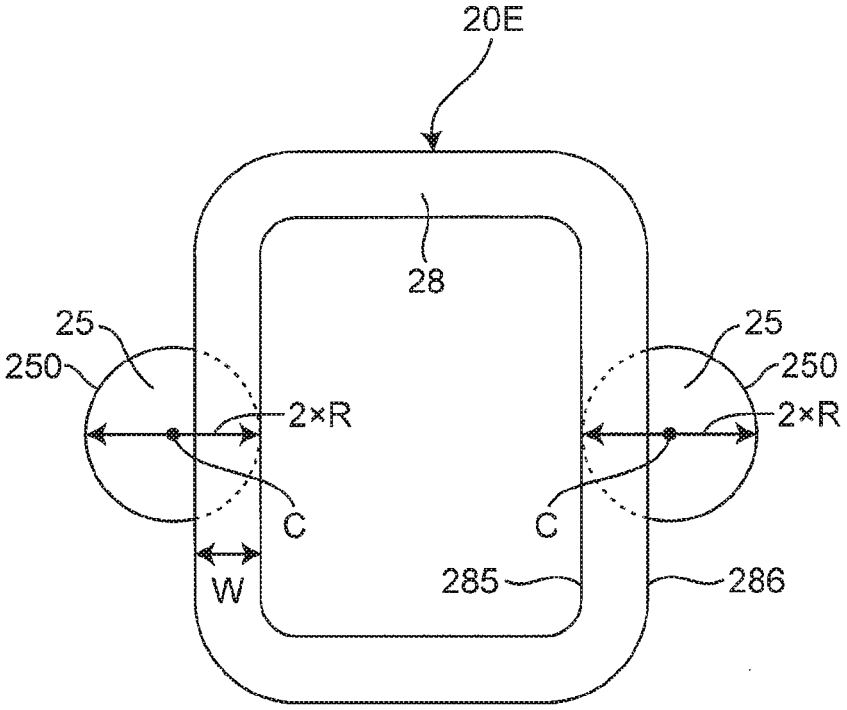
FIG. 11 is a diagram of a positional relationship between the land portion and the line portion viewed in the laminating direction according to a sixth embodiment of the present disclosure.

FIG. 11 is a plane view of a coil conductor of a laminated coil component according to a sixth embodiment of the present disclosure. The sixth embodiment is different from the first embodiment in the positional relationship between the land portion and the line portion.

As shown in FIG. 11, in a coil conductor 20E of the sixth embodiment, as is the case with the configuration of the first embodiment, the land portion 25 overlaps with the line portion 28 located on the opposite side of the pattern connecting portion 24 in the laminating direction when viewed in the laminating direction, and the center C of the land portion 25 does not overlap with the line portion 28 located on the opposite side of the pattern connecting portion 24 in the laminating direction when viewed in the laminating direction.

Additionally, when viewed in the laminating direction, the multiple line portions 28 partially overlap with each other to form a rectangular ring shape as a whole. The line portions 28 may be arranged in a circular shape or an elliptical shape.

The line portions 28 have the inner peripheral edge 285 and the outer peripheral edge 286 in the line width W direction. The centers C of the land portions 25 are located outside the outer peripheral edge 286 of the line portions 28. The inner peripheral edge 285 of the line portions 28 is in contact with the outer peripheral edges 250 of the land portions 25. Even in this case, when viewed in the laminating direction, the line width W of the line portions 28 is smaller than the radius R of the land portions 25.

According to the sixth embodiment, when viewed in the laminating direction, the centers C of the land portions 25 are located outside the outer peripheral edge 286 of the line portions 28 arranged in a ring shape and, therefore, the land portions 25 are hardly located inside the inner peripheral edge 285 of the line portions 28. Thus, impedance characteristics are improved.

The present disclosure is not limited to the embodiments and can be changed in design without departing from the spirit of the present disclosure. For example, respective feature points of the first to sixth embodiments may variously be combined.

EXAMPLES

Example

An example of the first embodiment of the present disclosure will be described.

Ni—Zn—Cu ferrite was uses as a raw material. Magnetic permeability was set to about 180 and the raw material powder was kneaded and mixed with a water-based acrylic binder, a dispersing agent, a plasticizer, etc. From the kneaded and mixed slurry, an 8-μm-thick magnetic green sheet supported by a carrier film was produced by a doctor blade method.

The sheet was subjected to laser processing to form a hole for a pattern connecting portion. Subsequently, a ¾-turn coil pattern portion having a print line width of 15 μm and a print coating thickness of about 10 μm was formed by screen printing using an Ag paste.

A green body laminated and pressure-bonded through a predetermined procedure was divided by a dicing saw into individual component units having a size of 0.250 mm×0.125 mm×0.125 mm before debindering and firing. Terminal Ag electrodes were formed by a thick-film dipping method and Ni—Sn-plated.

Experimental Results

Table 1 describes the experimental results of a short-circuit incidence rate of Example and Comparison Examples 1, 2. The short-circuit incidence rate was determined from attenuation of L-characteristics. The number of samples was 30.

TABLE 1

| | Example | Comparison Example 1 | Comparison Example 2 |
|---|---|---|---|
| R (μm) | 18 | 12 | 15 |
| W (μm) | 15 | 15 | 15 |
| short-circuit incidence rate (%) (n = 30) | 0 | 17 | 13 |

Figure 12A:
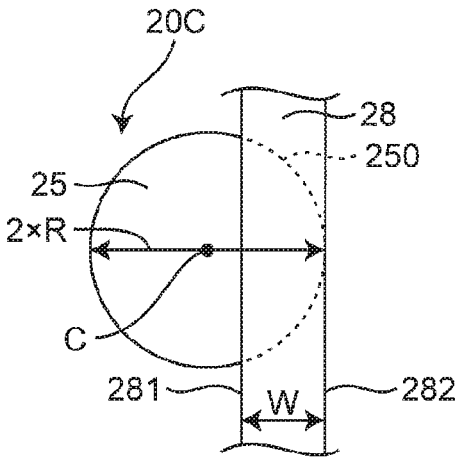
FIG. 12A is a diagram of a positional relationship between the land portion and the line portion of an Example viewed in the laminating direction.

In Table 1, Example indicates a short-circuit incidence rate of a laminated coil component having a positional relationship shown in FIG. 12A as the positional relationship between the land portion 25 and the line portion 28 viewed in the laminating direction. The coil conductor 20C shown in FIG. 12A is the same as the coil conductor 20C of the fourth embodiment. The radius R of the land portion 25 was 18 μm and the line width W of the line portion 28 was 15 μm.

Figure 12B:
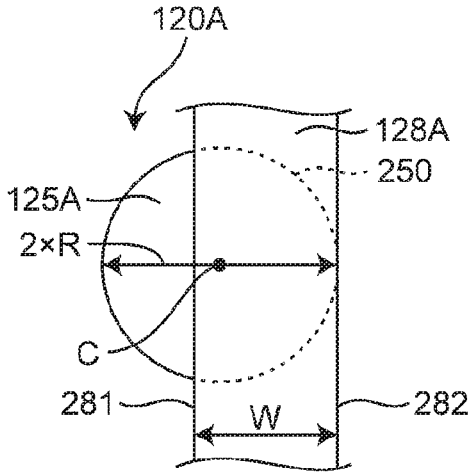
FIG. 12B is a diagram of a positional relationship between the land portion and the line portion of Comparison Example 1 viewed in the laminating direction.

In Table 1, Comparison Example 1 indicates a short-circuit incidence rate of a laminated coil component having a positional relationship shown in FIG. 12B as the positional relationship between the land portion 25 and the line portion 28 viewed in the laminating direction. In a coil conductor 120A, a center C of a land portion 125A overlaps with a line portion 128A when viewed in the laminating direction. The second end edge 282 of the line portion 128A is in contact with the outer peripheral edge 250 of the land portion 125A. The radius R of the land portion 125A was 12 μm and the line width W of the line portion 128A was 15 μm.

Figure 12C:
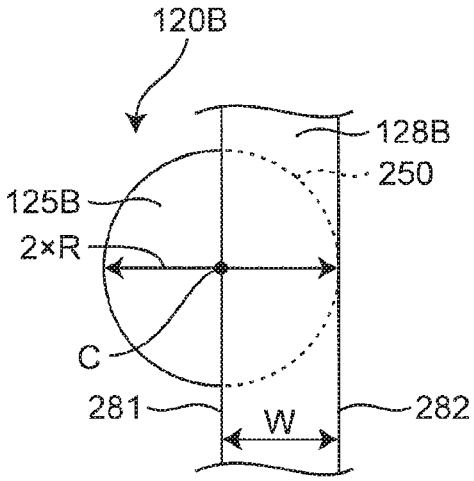
FIG. 12C is a diagram of a positional relationship between the land portion and the line portion of Comparison Example 2 viewed in the laminating direction.

In Table 1, Comparison Example 2 indicates a short-circuit incidence rate of a laminated coil component having a positional relationship shown in FIG. 12C as the positional relationship between the land portion 25 and the line portion 28 viewed in the laminating direction. In a coil conductor 120B, a center C of a land portion 125B overlaps with a line portion 128B when viewed in the laminating direction. The second end edge 282 of the line portion 128B is in contact with the outer peripheral edge 250 of the land portion 125B. The first end edge 281 of the line portion 128B is in contact with the center C of the land portion 125B. The radius R of the land portion 125B was 15 μm and the line width W of the line portion 128B was 15 μm.

As described in Table 1, the Example had the short-circuit incidence rate of 0%. In contrast, Comparison Example 1 had the short-circuit incidence rate of 17% and Comparison Example 2 had the short-circuit incidence rate of 13%.

In the Example, the thickness of the land portion 25 is maximized at the center C, which does not overlap with the line portion 28 located on the opposite side of the pattern connecting portion in the laminating direction. Therefore, a short circuit can be prevented between the land portion 25 and the line portion 28 arranged adjacently in the laminating direction.

In Comparison Example 1, since the thickness of the land portion 125A is maximized at the center C overlapping with the line portion 128A located on the opposite side of the pattern connecting portion in the laminating direction, a short circuit may occur between the land portion 125A and the line portion 128A. Similarly, in Comparison Example 2, since the thickness of the land portion 125B is maximized at the center C being in contact with the line portion 128A located on the opposite side of the pattern connecting portion in the laminating direction, a short circuit may occur between the land portion 125B and the line portion 128B.

The invention claimed is:

1. A laminated coil component comprising:

an element body formed by laminating a plurality of ceramic layers including first, second, and third ceramic layers, the second and third ceramic layers being located adjacent to the first ceramic layer at opposite sides of the first ceramic layer in a laminating direction of the ceramic layers; and a coil conductor disposed inside the element body, wherein the coil conductor has first and second coil pattern portions disposed on the first and second ceramic layers, respectively, the first and second coil pattern portions including first and second line portions and first and second land portions each disposed at a respective end of the first and second line portions, respectively, a third coil pattern portion disposed on the third ceramic layer and including a third line portion, and a pattern connecting portion connecting the first and second land portions to each other, the first land portion overlaps with the third line portion when viewed in the laminating direction such that the center of the first land portion does not overlap with the third line portion when viewed in the laminating direction, and when viewed in the laminating direction, the third line portion has first and second end edges, the first end edge is located farther from the center of the first land portion than the second end edge, and the first end edge is partially located inside an outer peripheral edge of the first land portion.

2. A laminated coil component comprising:

an element body formed by laminating a plurality of ceramic layers including first, second, and third ceramic layers, the second and third ceramic layers being located adjacent to the first ceramic layer at opposite sides of the first ceramic layer in a laminating direction of the ceramic layers; and a coil conductor disposed inside the element body, wherein the coil conductor has first and second coil pattern portions disposed on the first and second ceramic layers, respectively, the first and second coil pattern portions including first and second line portions and first and second land portions each disposed at a respective end of the first and second line portions, respectively, a third coil pattern portion disposed on the third ceramic layer and including a third line portion, and a pattern connecting portion connecting the first and second land portions to each other, the first land portion overlaps with the third line portion when viewed in the laminating direction such that the center of the first land portion does not overlap with the third line portion when viewed in the laminating direction, and when viewed in the laminating direction, the first to third line portions are arranged in a ring shape, and the centers of the first and second land portions are located inside the inner peripheral edge of the first to third line portions.

3. The laminated coil component according to claim 2, wherein when viewed in the laminating direction, the third line portion has first and second end edges, the first end edge is located farther from the center of the first land portion than the second end edge, and the first land portion has a portion located at a side of the first end edge opposite to the second end edge.

4. The laminated coil component according to claim 2, wherein when viewed in the laminating direction, the third line portion has first and second end edges, the first end edge is located farther from the center of the first land portion than the second end edge, and the first end edge is in contact with the outer peripheral edge of the first land portions.

5. The laminated coil component according to claim 2, wherein when viewed in the laminating direction, an area of an overlapping portion between the first land portion and the third line portion has a proportion of 50% or less relative to an area of the first land portion.

6. The laminated coil component according to claim 2, wherein when viewed in the laminating direction, each of the first and second land portions has a circular shape, and a line width of the straight part of the third line portion is smaller than a radius of the first and second land portions.

7. The laminated coil component according to claim 1, wherein when viewed in the laminating direction, each of the first and second land portions has a circular shape, and a line width of the first to third line portions is smaller than a radius of the first and second land portions.

8. The laminated coil component according to claim 1, wherein when viewed in the laminating direction, the first to third line portions are arranged in a ring shape, and the centers of the first and second land portions are located inside the inner peripheral edge of the first to third line portions.

9. The laminated coil component according to claim 1, wherein when viewed in the laminating direction, the first to third line portions are arranged in a ring shape, and the centers of the first and second land portions are located outside the outer peripheral edge of the first to third line portions.

10. The laminated coil component according to claim 1, wherein the third line portion has a straight part and a corner part, and the first land portion overlaps with the straight part of the third line portion when viewed in the laminating direction.

11. The laminated coil component according to claim 2, wherein when viewed in the laminating direction, each of the first and second land portions has a circular shape, and a line width of the first to third line portions is smaller than a radius of the first and second land portions.

* * * * *